US006017664A

United States Patent [19]

Obinata

[11] Patent Number: 6,017,664

[45] Date of Patent: Jan. 25, 2000

[54] PHOTOCONDUCTOR FOR ELECTROPHOTOGRAPHY

[75] Inventor: Takashi Obinata, Nagano, Japan

[73] Assignee: Fuji Electric Co., Ltd., Japan

[21] Appl. No.: 09/181,188

[22] Filed: Oct. 28, 1998

[30] Foreign Application Priority Data

Oct. 29, 1997 [JP] Japan ..... 9-296918

[51] Int. Cl.[7] ..... G03G 5/14

[52] U.S. Cl. ..... 430/58; 430/60; 430/63

[58] Field of Search ..... 430/58, 60, 63

[56] References Cited

U.S. PATENT DOCUMENTS

| | | | |
|---|---|---|---|
| 578,193 | 7/1897 | Suzuki et al. | 430/58 |
| 5,130,216 | 7/1992 | Koyama et al. | 430/63 |

FOREIGN PATENT DOCUMENTS

| | | | |
|---|---|---|---|
| 47-45548 | 11/1972 | Japan | 430/63 |
| 51-14893 | 5/1976 | Japan | 430/63 |
| 64-10257 | 1/1989 | Japan | 430/63 |
| 92/08168 | 5/1992 | WIPO | 430/63 |

*Primary Examiner*—Roland Martin
*Attorney, Agent, or Firm*—Morrison Law Firm

[57] ABSTRACT

A photoconductor for electrophotography containing an undercoating film, that remains largely unaffected by environmental factors. The photoconductor exhibits stable electrical properties and allows for thickening of the undercoating film so that dielectric breakdown is not caused even when a contact charging method is used. The photoconductor includes a conductive substrate, an undercoating film on the conductive substrate and a photosensitive film on the undercoating film. The undercoating film contains a conductive polymer, an alkaline metal salt, a binder resin and an inorganic pigment.

16 Claims, 14 Drawing Sheets

(I-1)

(I-2)

(I-3)

(I-4)

(I-5)

(I-6)

(I-7)

(I-8)

(I-9)

(I-10)

(I-11)

(I-12)

(I-13)

(I-14)

(I-15)

(I-16)

(I-17)

(I-18)

(I-19)

(I-20)

(I-21)

(I-22)

(I-23)

(I-24)

(II-1)

(II-2)

(II-3)

(II-4)

(II-5)

(II-6)

(II-7)

(II-8)

(II-9)

(II-10)

(II-11)

(II-12)

(III-1)

(III-2)

(III-3)

(III-4)

(III-5)

(III-6)

(III-7)

(IV-1)

(IV-2)

(IV-3)

(IV-4)

(IV-5)

(IV-6)

(IV-7)

(IV-8)

(IV-9)

(IV-10)

(IV-11)

(IV-12)

(IV-13)

(IV-14)

(IV-15)

(IV-16)

(IV-17)

(IV-18)

(IV-19)

(IV-20)

(IV-21)

(IV-22)

(IV-23)

(IV-24)

(IV-25)

(IV-26)

(IV-27)

(IV-28)

(IV-29)

(IV-30)

(IV-31)

(IV-32)

(IV-33)

(IV-34)

(IV-35)

(IV-36)

(IV-37)

(IV-38)

(IV-39)

(IV-40)

(IV-41)

(IV-42)

(IV-43)

(IV-44)

(IV-45)

(V)

(VI)

(VII)

(VIII)

PHOTOCONDUCTOR FOR ELECTROPHOTOGRAPHY

BACKGROUND OF THE INVENTION

The present invention relates to a photoconductor for electrophotography (hereinafter "photoconductor") for use in electrophotographic apparatuses such as printers and copying machines.

A basic photoconductor structure includes an electrically conductive substrate (hereinafter "substrate") and a photosensitive film on the substrate. The photosensitive film may include a charge generation layer and a charge transport layer. An undercoating film is interposed between the substrate and the photosensitive film to cover surface defects on the substrate, facilitate obtaining a uniform photosensitive film, improve adhesiveness between the substrate and the photosensitive film and prevent charge injection from the substrate to the photosensitive film. The undercoating film is made of resin or contains inorganic pigment dispersed into binder resin.

In addition to the previously described requirements, the undercoating film must also exhibit electrical resistance low enough to avoid adversely affecting the electrophotographic properties of the photoconductor structure. The undercoating film should not change charging potential, residual potential or sensitivity when the photoconductor is used repeatedly or when subject to environmental conditions. Environmental conditions that adversely affect electrographic properties include a low temperature/low humidity environment, or, when the photoconductor is used in a high temperature/high humidity environment.

Inorganic pigments are used to either prevent laser beam interference or to adjust the electrical resistance of the undercoating film. However, when inorganic pigment is dispersed into the undercoating film, aggregation of the pigment occurs. This in turn causes defects such as concave and convex portions and pin holes in the undercoating film. The defects prevent formation of an undercoating film that is adequately uniform.

The undercoating film must exhibit an appropriate breakdown voltage to avoid image defects due to dielectric breakdown which occurs when the so called contact charging method is employed. When the contact charging method is employed, the photoconductor is charged by applying a voltage directly onto the photoconductor surface.

Resin undercoating films which contain no additives have been considered for use in a photoconductor structure. Preferable conventional resins for the undercoating film include acrylic resin, polyamide resin, vinyl chloride resin, vinylidene chloride resin, polycarbonate resin, poly(vinyl alcohol) resin, phenolic resin, polyurethane resin, and polyimide resin. When these resins are used without additives, they have high electrical resistance. The high electrical resistance causes a lowered sensitivity and a rise in residual potential in the photoconductor. The lowered sensitivity and rise in residual potential cause low image density and fog (stained background). Tremendous sensitivity lowering and rise in residual potential result when the undercoating film is thick enough to completely cover the surface defects on the substrate or to adjust the breakdown voltage. This is especially true when the photoconductor is used in a low temperature and low humidity environment. Therefore, a resin undercoating film which does not contain an additive is not practical for use in a photoconductor structure.

Alternatives have been proposed for adjusting the electrical resistance and for obviating the foregoing problems.

These alternatives include the addition of an additive to the undercoating film. These additives include a filler containing metal powders such as Al and Ni, addition of conductive metal oxide such as indium oxide, tin oxide and zinc oxide or addition of carbon black. However, it is difficult to uniformly disperse fillers such as metal power and conductive metal oxide into the undercoating film. Aggregation of the filler causes defects in the coating film.

Another proposed solution to the above problems is to add so-called low-molecular-weight-type surface active agents to the undercoating layer. These surface active agents include: non-ionic surface active agent such as poly (oxyethylene alkylether) and glycerol fatty acid ester, an anionic surface active agent such as sodium alkylsulfonate, and a cationic surface active agent such as tetaalkylammonium salt. In doping the low-molecular-weight-type surface active agent in the undercoating film, surface defects are often caused due to bleeding out (segregation) of surface active agent during the formation of the undercoating film. The surface active agent is so hygroscopic that the undercoating film containing the surface active agent is adversely affected by environmental changes, especially changes in humidity.

In making a photoconductor which includes a substrate, an undercoating film on the substrate and a photosensitive film on the undercoating film, the photosensitive film is usually formed by dip-coating or by spray-coating. Some types of solvents contained in the photosensitive film coating liquid can dissolve or otherwise transform the undercoating film. The resulting uneven and non-uniform coating film causes irregular distribution of the potential and degraded image qualities.

OBJECTS AND SUMMARY OF THE INVENTION

In view of the foregoing, it is an object of the invention to overcome the problems of the prior art.

It is another object of the invention to provide a photoconductor including an undercoating film which is not affected by environmental changes.

It is another object of the invention to provide a photoconductor which exhibits stable electrophotographic properties of the photoconductor.

It is still another object of the invention to provide a photoconductor which facilitates thickening the undercoating film without deteriorating the electrophotographic properties of the photoconductor.

It is a further object of the invention to provide a photoconductor which causes little dielectric breakdown even when contact charging is used in the electrophotographic process.

It is a further object of the present invention to provide a photoconductor which reduces the costs for finishing and cleaning a substrate surface since the residual potential is not raised, and charges are not accumulated by repeated use of the photoconductor, even when the undercoating film is thick enough to completely cover the surface defects on the substrate surface. The thick undercoating film having a higher breakdown voltage than the charging voltage helps prevent dielectric breakdown from causing image defects even when the contact charging method is employed.

It is still a further object of the invention to employ a thermosetting resin for use as a binder resin of an undercoating film, where the undercoating film is used in a photoconductor. The undercoating film is hardly dissolved by the solvent of the coating liquid for the photosensitive film. Adhesiveness of the substrate and the photosensitive film is improved.

It is still a further object of the invention to facilitate efficient light scattering by adjusting the refractive index, grain diameter and surface conditions of an inorganic pigment used in an undercoating layer of a photoconductor. By adjusting the grain diameter and surface conditions of an inorganic pigment, dispersion of the pigment in the coating liquid for the undercoating film is stabilized. The stabilized pigment dispersion results in an undercoating film that is effective in preventing poor images due to laser beam interference even when the photoconductor is adapted to the electrophotographic apparatus using a laser as a light source.

Briefly stated, the present invention provides that a photoconductor for electrophotography contains an undercoating film that remains largely unaffected by environmental factors. The photoconductor exhibits stable electrical properties and allows for thickening of the undercoating film so that dielectric breakdown is not caused even when a contact charging method is used. The photoconductor includes a conductive substrate, an undercoating film on the conductive substrate and a photosensitive film on the undercoating film. The undercoating film contains an electrically conductive polymer, an alkaline metal salt, a binder resin and an inorganic pigment.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
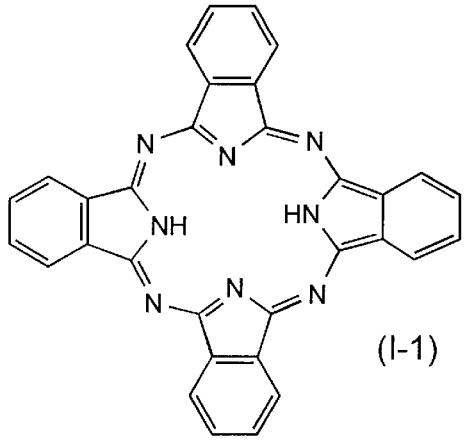
FIG. 1 describes the structural formulas I-1 through I-6 of the representative organic pigments used in the charge generation layer of the photoconductor according to the invention.
Figure 1:
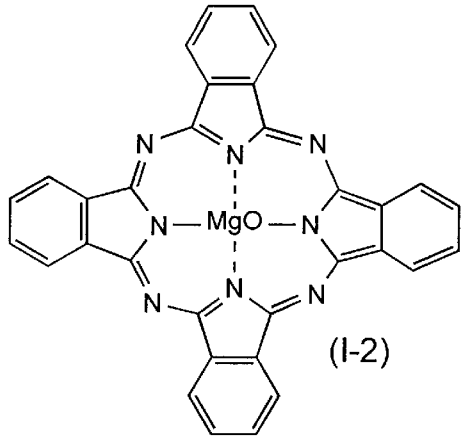
Figure 1:
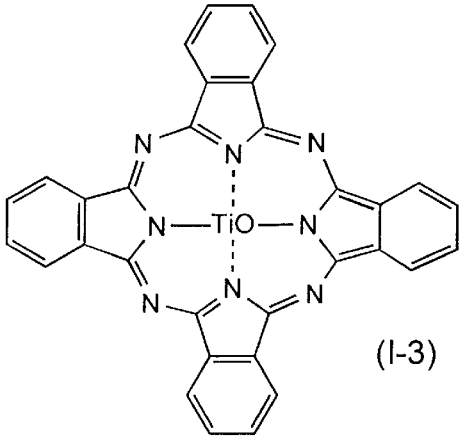
Figure 1:
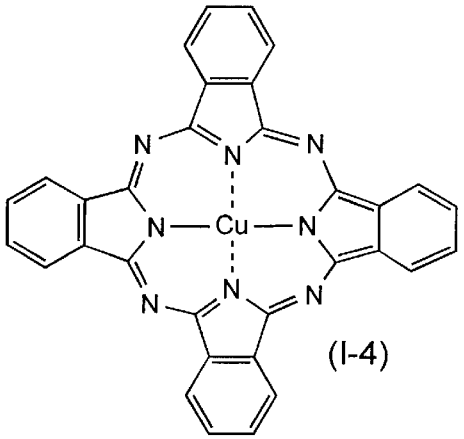
Figure 1:
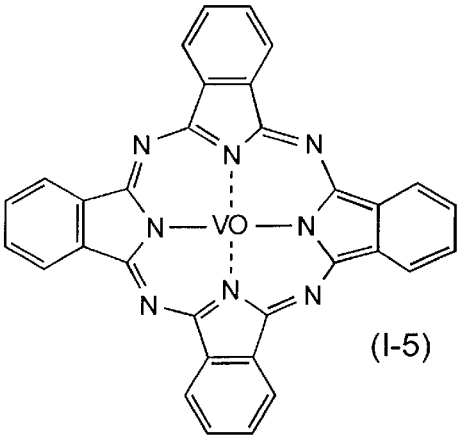
Figure 1:
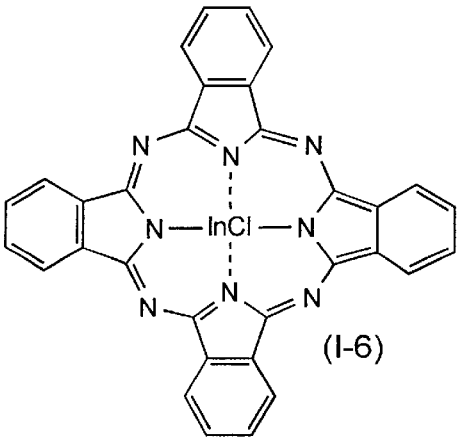
Figure 2:
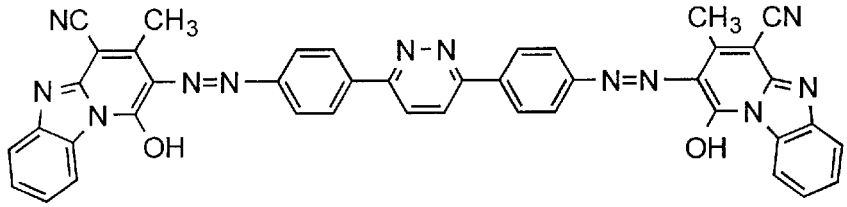
FIG. 2 describes the structural formulas I-7 through I-12 of the representative organic pigments used in the charge generation layer of the photoconductor according to the invention.
Figure 2:
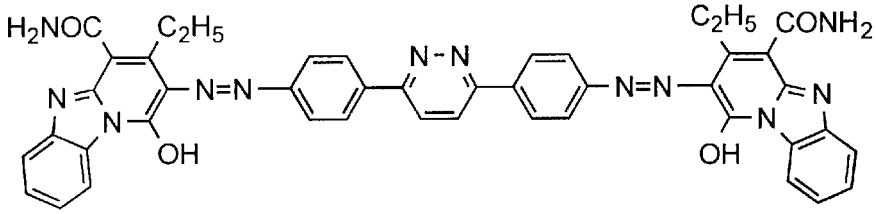
Figure 2:
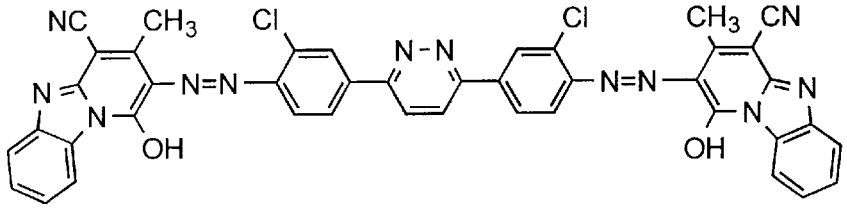
Figure 2:
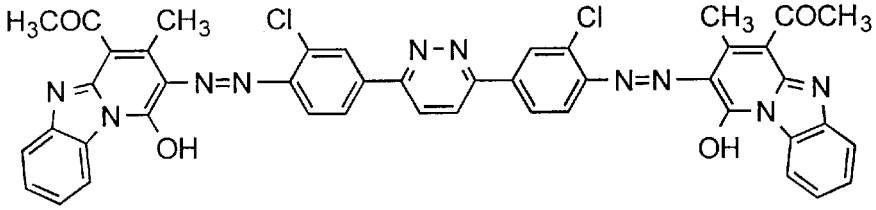
Figure 2:
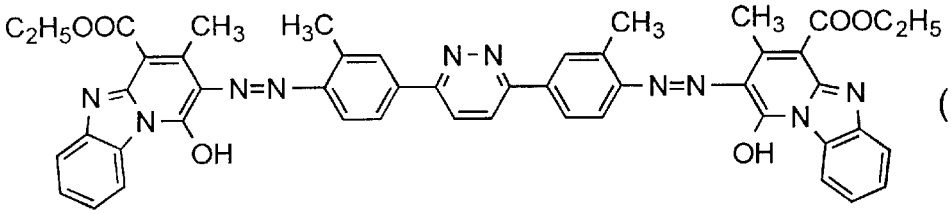
Figure 2:
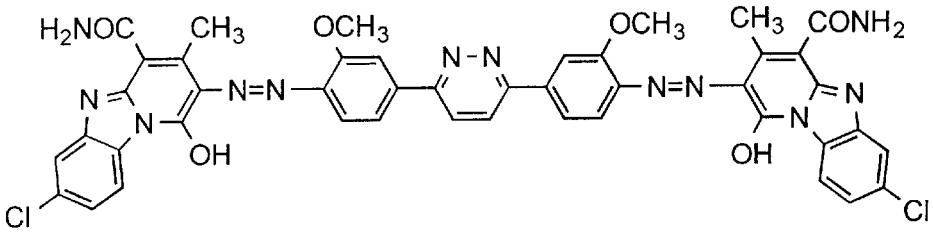
Figure 3:
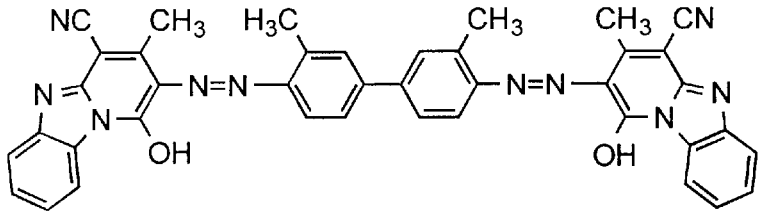
FIG. 3 describes the structural formulas I-13 through I-18 of the representative organic pigments used in the charge generation layer of the photoconductor according to the invention.
Figure 3:
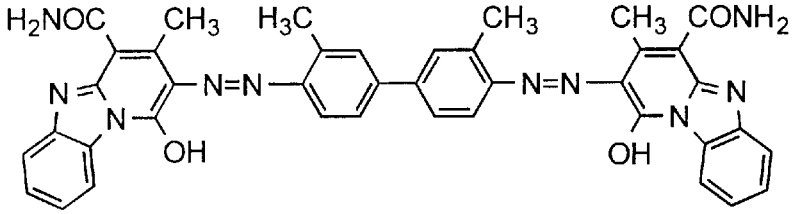
Figure 3:
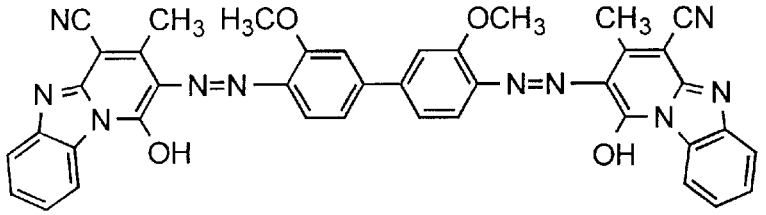
Figure 3:
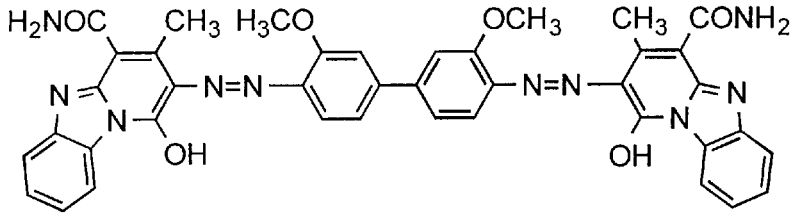
Figure 3:
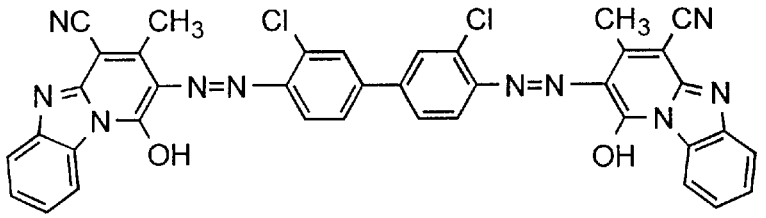
Figure 3:
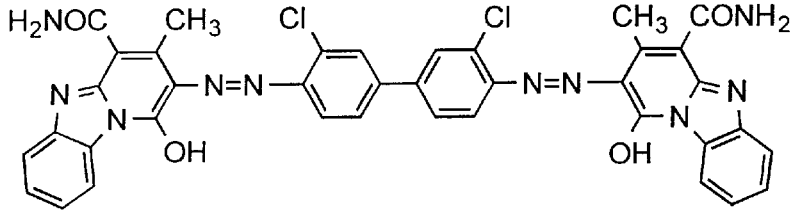
Figure 4:
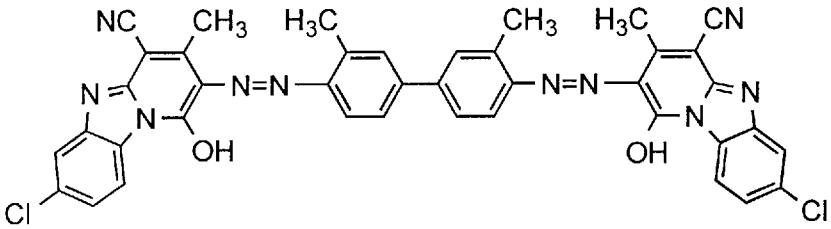
FIG. 4 describes the structural formulas I-19 through I-24 of the representative organic pigments used in the charge generation layer of the photoconductor according to the invention.
Figure 4:
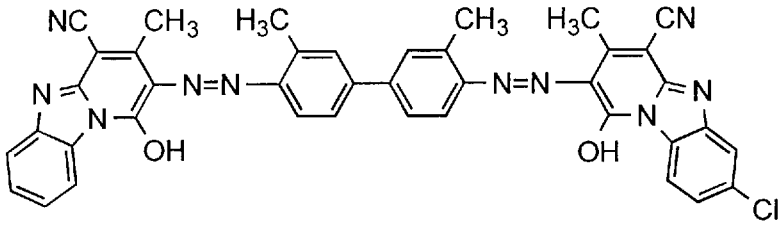
Figure 4:
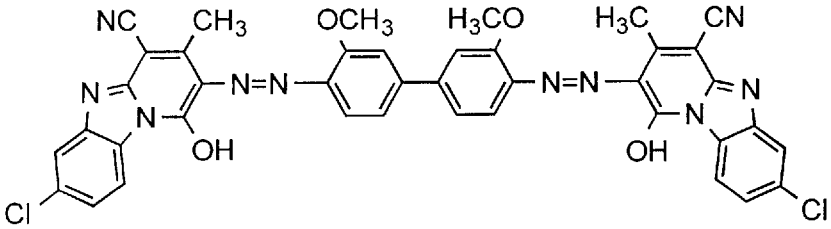
Figure 4:
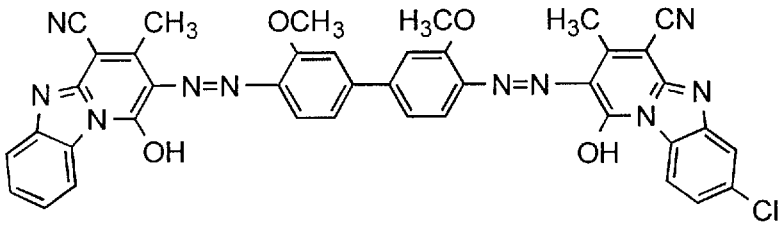
Figure 4:
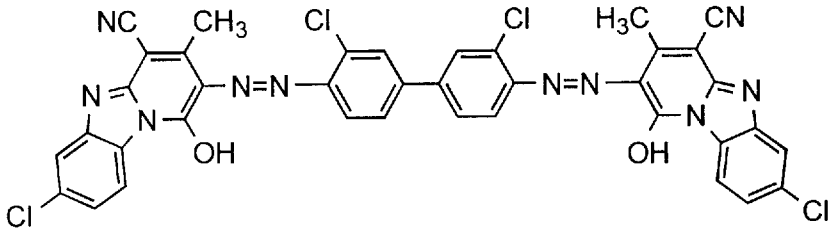
Figure 4:
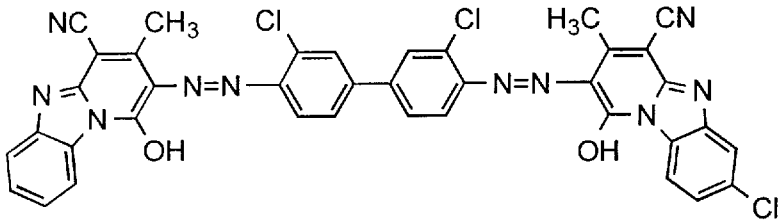

According to the present invention, a photoconductor for electrophotography includes an undercoating film having a conductive polymer, an alkaline metal salt, a binder resin and an inorganic pigment that prevents the charging potential, residual potential and sensitivity of the photoconductor from being adversely affected by environmental changes and which facilitates obtaining stable and excellent image quality.

The substrate is made of a metallic material such as aluminum, nickel, chrome or stainless steel. A plastic material on which a film of aluminum, titanium, nickel, chrome, stainless steel, tin oxide, indium oxide or indium titanium oxide (ITO) is disposed may also be used as the substrate. Alternatively, a plastic material and paper covered with an electrically conductive material, or a plastic material and paper into which an electrically conductive material is impregnated may be used for the substrate. The conductive substrate may be shaped in the forms of, but not limited to, a drum, a sheet and a plate. If necessary, the substrate surface may be subject to oxidation, treatment with reagents, coloring treatment and anti-reflection treatment by sandblasting.

A "conductive polymer" can be used for the undercoating film. Such a polymer exhibits electrical conductivity through its interaction with the anions or cations yielded by the dissociation of the alkaline metal salt.

Advantageously, the conductive polymers used for the undercoating film include a polymer having a poly(ethylene oxide) structure, a polymer having a polyester structure, a polymer having a polyimine structure and a polymer having a quaternary ammonium base.

Polymers having a poly(ethylene oxide) structure include polyethers such as poly(ethylene oxide), poly(propylene oxide), polyepihalohydrin, poly(ether ester amide), poly (ether amide imide) and methoxypoly(ethylene glycol methacrylate) and copolymers of these polyethers. Also included are a poly(methacrylic acid) and a poly(itaconic acid) each having side chains containing a poly(ethylene oxide) structure. In addition, a polyphosphazene or a phosphate each having side chains containing a poly(ethylene oxide) structure may also be used.

The polymers having a poly ester structure include polyester resins, synthesized from various kinds of glycol and dibasic acid, such as poly(ethylene terephthalate) and polymethacryloligooxyethylene.

The polymer having a quaternary ammonium base structure include acrylate copolymers, methacrylate copolymers, maleimide copolymers and methacrylimide copolymers containing a quaternary ammonium base.

Since the molecular weights of these conductive polymers are higher than those of the conventional surface active agents of the relatively-low-molecular-weight-type, surface defects due to bleeding out of the polymer during the formation of the undercoating film are prevented. The conductive polymers are stable against environmental changes, since the conductive polymers exhibit little humidity dependence.

In particular, the polymer having the poly(ethylene oxide) structure facilitates realizing high electrical conductivity. This polymer promotes salt dissociation in the presence of alkaline metal (due to the polar group such as ether oxygen) and forms a complex by the strong interaction with the yielded anions or cations.

Preferably, the conductive polymer has a glass transition temperature of 120° C. or lower. In the presence of the conductive polymer and alkaline metal salt, the cations or anions produced by the dissociation of the salt are transported by the motion of segments of the polymer. Therefore, it is believed that conductive polymers having a high glass transition temperature do not possess high electrical conductivity because the segment motion of the polymer is frozen.

The salts of alkaline metals include $CF_3SO_3$ salts, $ClO_4$ salts, $IO_4$ salts, $MoO_4$ salts, $WO_4$ salts, $BF_4$ salts, $SiF_6$ salts, $CS_3$ salts, SCN salts, $NO_3$ salts and $CO_3$ salts of lithium, sodium and potassium. In particular, the preferable alkaline metal salts include $LiCF_3SO_3$, $LiClO_4$, $LiIO_4$, $Na_2MoO_4$, $K_2WO_4$, $LiBF_4$, $NaBF_4$, $K_2SiF_6$, $K_2CS_3$, LiSCN, $NaNO_3$ and $NaCO_3$. Halides of alkaline metals such as LiCl, LiBr, LiI, NaI and KI may be also used.

The carrier transport in the undercoating film of the invention is hardly affected by changes in humidity. The charges are transported by the cations or anions produced by the dissociation of the above described alkaline metal salt. As a result of the above, electrical conduction and electrical properties of the photoconductor with this undercoating film, are stable against environmental changes.

When electrical resistance is adjusted by conventional conductive metal oxides, aggregation of the metal oxide powder tends to cause film defects. In contrast, when the electrical resistance is adjusted by the conductive polymer according to the invention, the problems described above will not occur. The conductive polymer of the present invention is soluble in organic solvents and water, which avoids the problem of the conventional conductive metal oxides.

The undercoating film according to the invention may be thickened without causing any sensitivity lowering and residual potential rise. For example, when using the contact charging method, an undercoating film which is from 5 to 20 μm thick can be used. This is thick enough to completely cover surface defects on the substrate surface, realize a high breakdown voltage and prevent dielectric breakdown of the photoconductor structure.

The binder resins for the undercoating film include thermoplastic resins such as poly(vinyl butyral) resin, poly(vinyl alcohol) resin, poly(vinyl acetate) resin, polyacrylate resin, polymethacrylate resin, polyester resin, polyamide resin, polystyrene resin and polycarbonate resin, and thermosetting resins such as polyurethane resin, phenolic resin, epoxy resin and melamine resin. These resins are used alone or in an appropriate combination.

When a photosensitive film will be coated on the undercoating film by dip-coating, it is preferable to use a thermosetting resin for the undercoating film. The thermosetting resin results in an undercoating film that is virtually insoluble to the solvent used in the coating liquid for the photosensitive film. Thus, the undercoating film is not decomposed or transformed by the solvent for the photosensitive film.

The total dose amount of the conductive polymer and the alkaline metal salt to the binder resin is preferably from 0.1% to 30% by weight and, more preferably, from 1% to 10% by weight. Depending on the required electrical resistance of the undercoating film and the compatibility with the binder resin, the dose amount of the conductive polymer, the alkaline metal salt to the binder resin and the mixing ratio of the conductive polymer and the alkaline metal salt may be optimized.

When a photoconductor uses a laser light source, interference between the incident and reflected light beams may occur. Printing defects from the interference can be easily avoided by heavy doping of the inorganic pigment. However, the heavily doped inorganic pigment may cause deterioration of the coating liquid due to precipitation. Heavy doping may also cause coating film defects. When using a photoconductor with a laser light source, an undercoating film of the present invention must contain inorganic pigment such as metal oxide and metal nitride to prevent printing defects from the interference. To efficiently prevent laser beam interference, caused by lightly doped inorganic pigment, it is desirable to use an inorganic pigment, having a refractive index of 1.8 or higher. Examples of such inorganic pigments include titanium oxide, zinc oxide, tin oxide, antimony oxide and zinc sulfide.

The preferable average grain diameter of the inorganic pigment is 0.4 μm or shorter. For scattering the laser beam, having a wavelength from 0.4 to 0.8 μm, it is preferable to use an inorganic pigment having an average grain diameter of about half the wavelength of the laser beam, i.e., from 0.2 to 0.4 μm.

Furthermore, it is desirable to avoid minute printing defects due to aggregation of the inorganic pigment by treating the inorganic pigment surface with a silane coupling agent. This treatment improves dispersion of the inorganic pigment so that aggregation of the organic pigment does not result. The appropriate inorganic pigment is selected based on the binder resin for the undercoating film, the solvent for the binder resin and the kind of inorganic pigment. The preferred silane coupling agents include vinyltrichlorosilane, vinyltrimethoxysilane, vinyltriethoxysilane, vinyltriacetoxysilane, γ-glycidoxypropyltrimethoxy silane, γ-methacryloxypropyltrimethoxysilane, γ-aminopropyltrimethoxy silane, γ-aminopropyltriethoxysilane, γ-mercaptopropyltrimethoxysilane and γ-3,4-epoxycyclohexyltrimethoxysilane. The suitable treating amount of the silane coupling agent with respect to the inorganic pigment is from 0.5% to 5% by weight.

By optimizing the refractive index and average grain diameter of the inorganic pigment in the undercoating film, deterioration of the coating liquid for the undercoating film due to precipitation of the inorganic pigment is avoided. Further, surface treatment of the inorganic pigment reduces or eliminates coating film defects due to aggregation of the inorganic pigment.

Depending on the materials used in the photosensitive film and the undercoating film, free carriers may be injected from the undercoating film to the photosensitive film. The injected free carriers lower the charging potential. The lowered charging potential further causes printing defects. In order to avoid this problem, an additional resin layer is interposed between the undercoating film and the photosensitive film. This additional resin layer contains no conductive polymer or alkaline metal salt.

Usually, the resins for the undercoating film are used alone or in an appropriate combination for the additional resin layer.

A photoconductor of the invention may be a negative-charging-type photoconductive film or laminate-type photoconductive film. In the laminate-type photoconductor, the photosensitive film on the undercoating film includes a charge generation layer and a charge transport layer laminated on one another.

The charge generation layer contains an organic pigment such as an azo pigment, a phthalocyanine pigment, a bisazo pigment, an indigo pigment and a perylene pigment. The charge generation layer may contain an alternative inorganic pigment such as selenium powder, amorphous silicon powder and zinc oxide powder. The structural formulas I-1 through I-24 of the representative examples of the organic pigments are described in FIGS. 1 through 4.

Coating liquid for the charge generation layer is prepared by dispersing one of the aforementioned pigments into a solution of a binder resin. The binder resin may be a polyester resin, a polycarbonate resin, a poly(vinyl butyral) resin, a poly(vinyl acetal) resin, a poly(vinyl chloride) resin, a vinyl acetate resin and a polystyrene resin. A charge generation layer is formed by applying a coating liquid on the undercoating film, and drying the coating liquid thereon. The appropriate thickness of the charge generation layer is from 0.1 to 2 $\mu$m.

Coating liquid for the charge transport layer is prepared by dissolving a charge transport agent into an appropriate solvent. Examples of charge transport agents include a hydrazone compound, a triphenylamine compound, a stilbene compound, an enamine compound, a polycyclic aromatic compound and a nitrogen-containing heterocyclic compound. A resin, which is compatible with the charge transport agent, is added to the charge transport layer. Such resins include a polyester resin, a polycarbonate resin, a poly(vinyl butyral) resin, vinyl acetate resin and a polystyrene resin. A charge transport layer, 5 to 40 $\mu$m thick, is formed on the charge generation layer by coating and drying the coating liquid on the charge generation layer. The structural formulas II-1 through II-12 of the representative charge transport agents are described in FIGS. 5 and 6. The structural formulas III-1 through III-7 of the representative polycarbonate resins are described in FIG. 7. Various kinds of antioxidants are added to the charge transport layer to prevent deterioration by light, heat, ozone and other such external influences. The structural formulas IV-1 through IV-45 of the representative antioxidants are described in FIGS. 8 through 13.

The undercoating film according to the invention may also be used in positive-charging and mono-layered-type photoconductors, where the photosensitive film contains a charge generation agent and a charge transport agent mixed into a binder resin.

The above, and other objects, features and advantages of the present invention will become apparent from the following description including preferred embodiments and comparative examples.

EMBODIMENTS 1 THROUGH 4 (E1 THROUGH E4)

A resin solution was prepared by dissolving 12 weight parts of block isocyanate (Dismodule CT Stable supplied from Sumitomo Bayer Urethane Co., Ltd.) and 8 weight parts of acrylpolyol (Dismodule A165 supplied from Sumitomo Bayer Urethane Co., Ltd.) into 58 weight parts of tetrahydrofuran. A surface of titanium oxide (grain diameter: 0.3 $\mu$m, refractive index: 2.52, trade name TA-200, supplied from Fuji Titanium Industries Co., Ltd.) was treated with $\gamma$-aminopropyltrimethoxysilane. Twenty weight parts of surface treated titanium oxide, were dispersed into the resin solution, prepared as described above, for 48 hours with alumina balls of 10 mm diameter in a ball mill.

Coating liquid for each embodiment was prepared by dissolving 1 weight part of a conductive polymer and 1 weight part of an alkaline metal salt into the dispersion liquid as described above. The conductive polymer for the embodiment 1 (E1) was polyepichlorohydrin, having the structural formula (V) as described in FIG. 14. The conductive polymer for the embodiment 2 (E2) was poly (methacrylic acid) with a poly(ethylene oxide) side chain, having the structural formula (VI) as described in FIG. 15. The conductive polymer for the embodiment 3 (E3) was polymethacrylate copolymer containing a quaternary ammonium base, having the structural formula (VII) as described in FIG. 16. The conductive polymer for the embodiment 4 (E4) was polyphosphazene with a poly(ethylene oxide) side chain, having the structural formula (VIII) as described in FIG. 17.

The alkaline metal salts for embodiments E1 through E4 are listed in Table 1 together with their respective conductive polymers. A 10 $\mu$m thick undercoating film was formed on an aluminum cylindrical tubular substrate, 30 mm in outer diameter, by dip-coating the substrate with a coating liquid and by drying the coating liquid at 140° C. for 30 minutes.

A coating liquid for the charge generation layer was prepared by dissolving 1 weight part of poly(vinyl butyral) resin (S.LEC BL-S supplied from Sekisui Chemical Co., Ltd.) into 98 weight parts of tetrahydrofuran and by dispersing 1 weight part of X-type metal free phthalocyanine, having the structural formula (I-1) as described in FIG. 1, into the tetrahydrofuran solution in a ball mill for 48 hours. A charge generation layer of 0.2 $\mu$m in thickness was formed by dip-coating the charge generation coating liquid onto the undercoating film and drying the coating liquid at 100° C. for 10 minutes.

Figure 5:
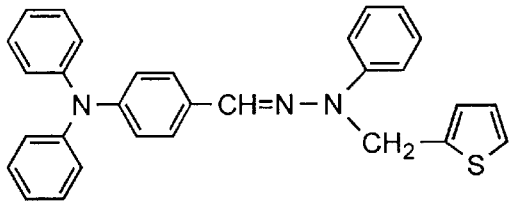
FIG. 5 describes the structural formulas II-1 through II-6 of the representative charge transport agents.
Figure 5:
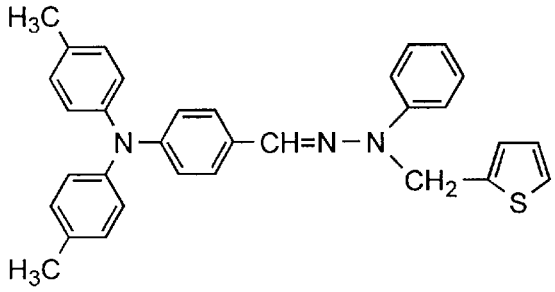
Figure 5:
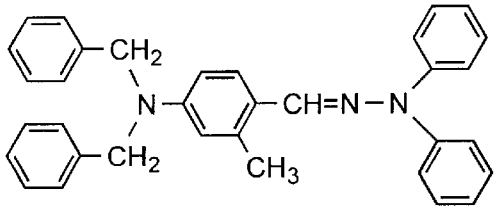
Figure 5:
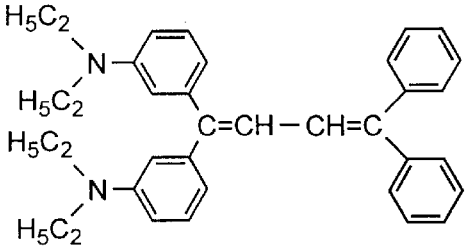
Figure 5:
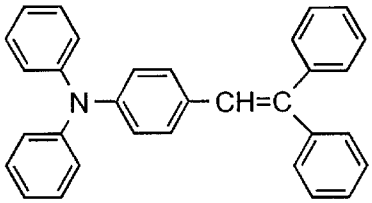
Figure 5:
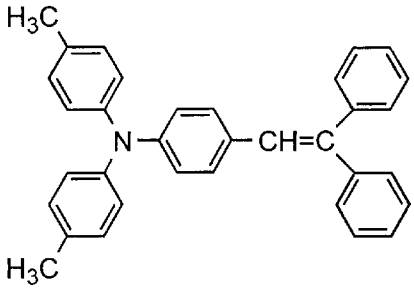
Figure 6:
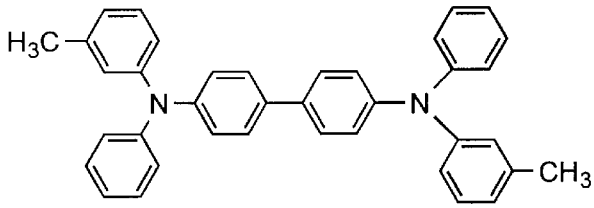
FIG. 6 describes the structural formulas II-7 through II-12 of the representative charge transport agents.
Figure 6:
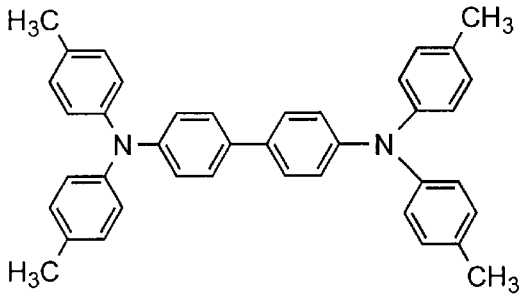
Figure 6:
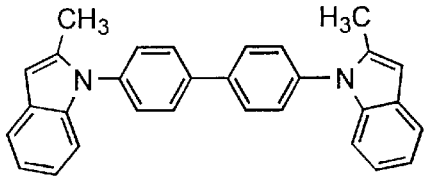
Figure 6:
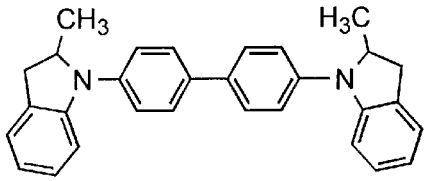
Figure 6:
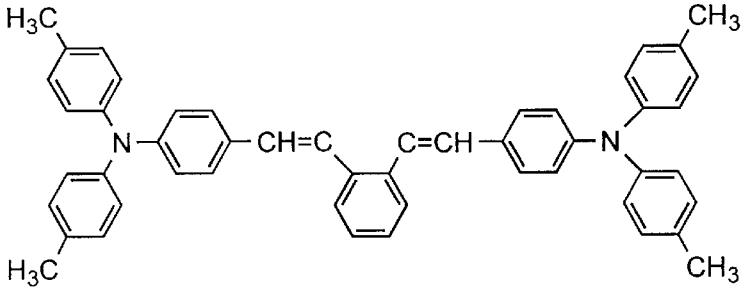
Figure 6:
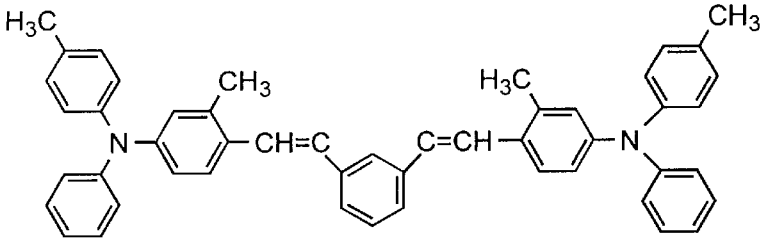
Figure 7:
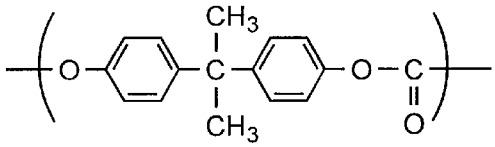
FIG. 7 describes the structural formulas III-1 through III-7 of the representative polycarbonate resins.
Figure 7:
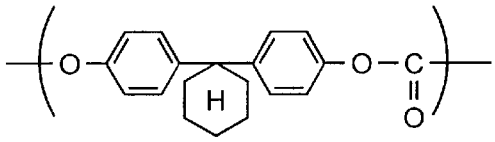
Figure 7:
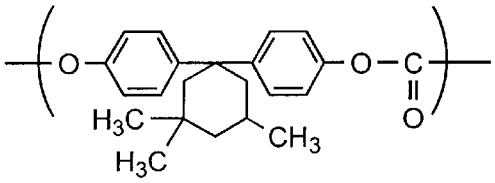
Figure 7:
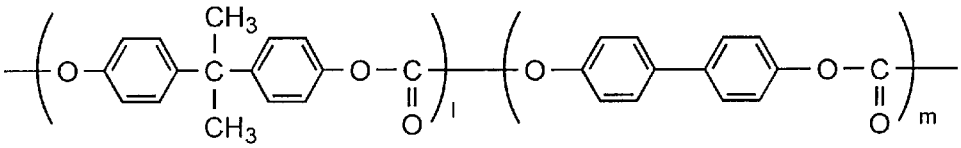
Figure 7:
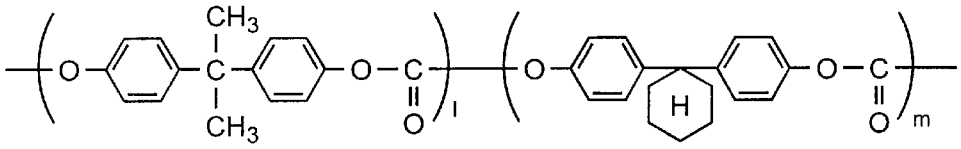
Figure 7:
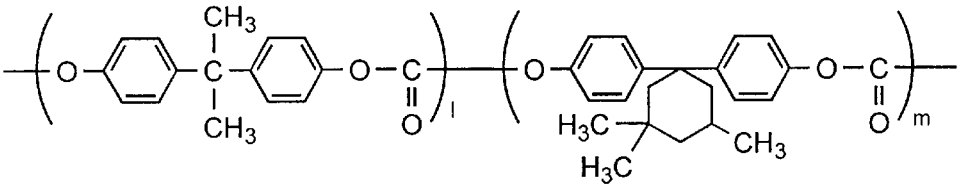
Figure 7:
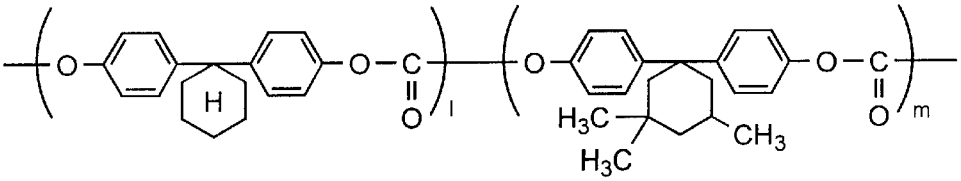
Figure 8:
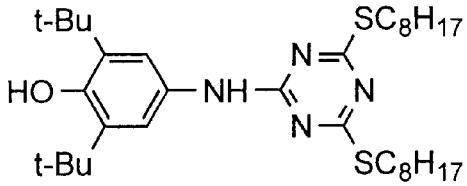
FIG. 8 describes the structural formulas IV-1 through IV-6 of the representative antioxidants.
Figure 8:
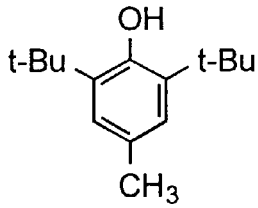
Figure 8:
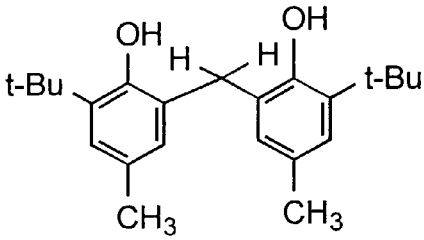
Figure 8:
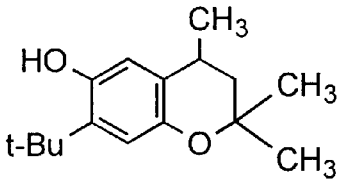
Figure 8:
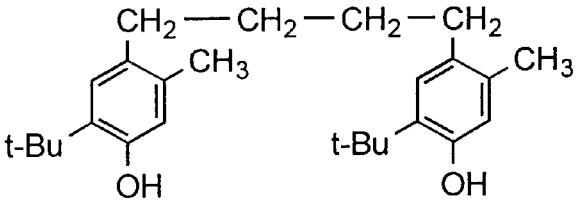
Figure 8:
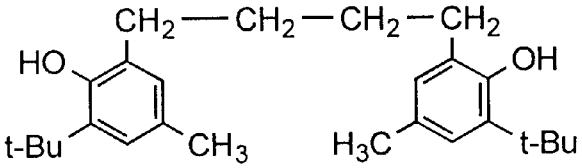
Figure 9:
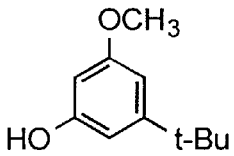
FIG. 9 describes the structural formulas IV-7 through IV-14 of the representative antioxidants.
Figure 9:
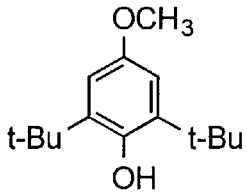
Figure 9:
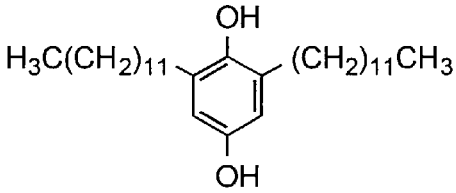
Figure 9:
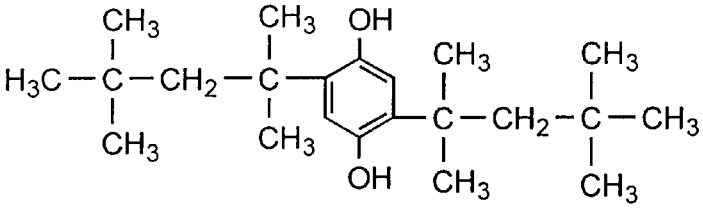
Figure 9:
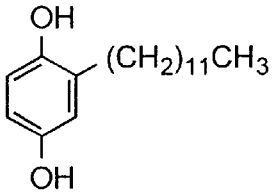
Figure 9:
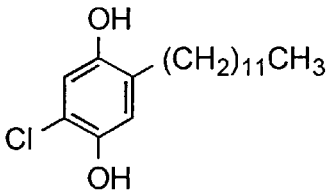
Figure 9:
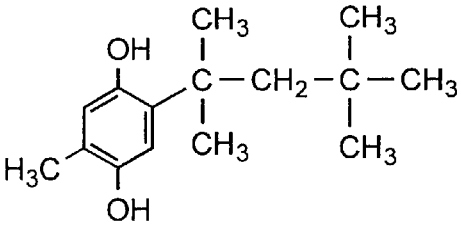
Figure 9:
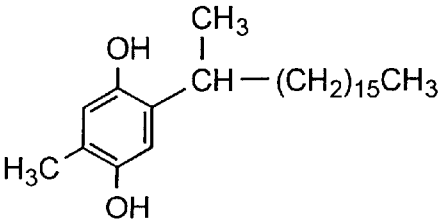
Figure 10:
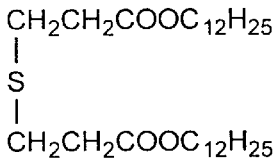
FIG. 10 describes the structural formulas IV-15 through IV-22 of the representative antioxidants.
Figure 10:
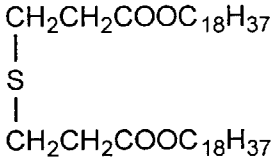
Figure 10:
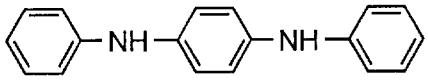
Figure 10:
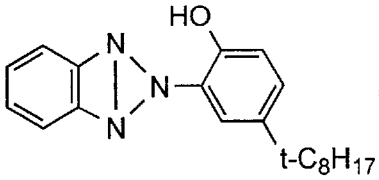
Figure 10:
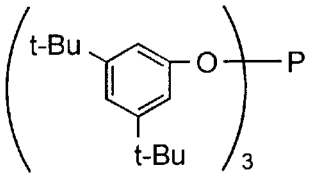
Figure 10:
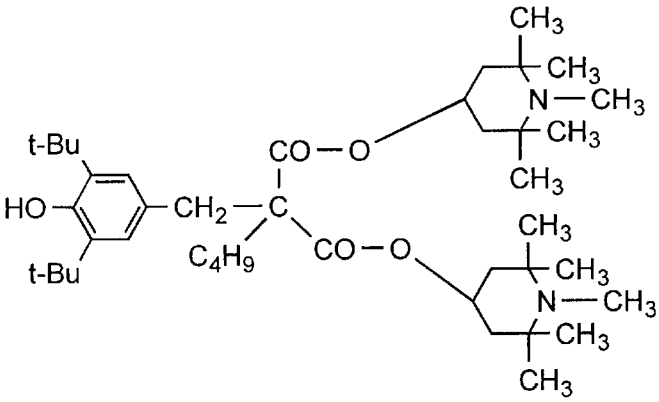
Figure 10:
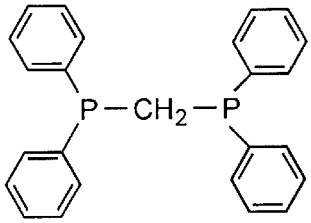
Figure 10:
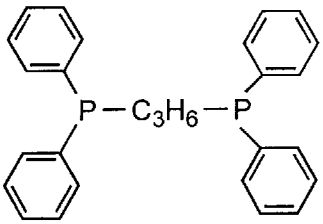
Figure 11:
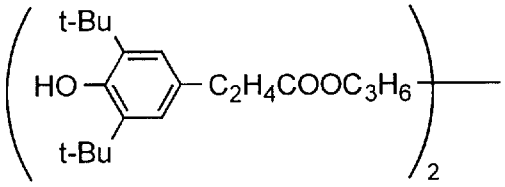
FIG. 11 describes the structural formulas IV-23 through IV-29 of the representative antioxidants.
Figure 11:
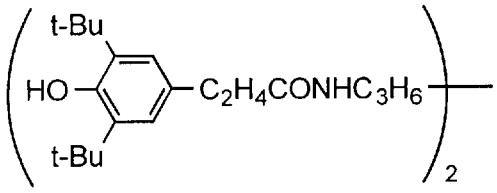
Figure 11:
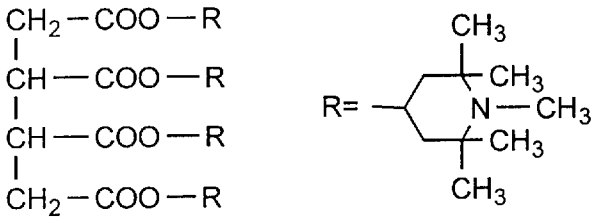
Figure 11:
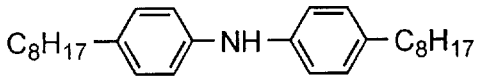
Figure 11:
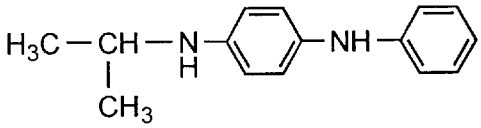
Figure 11:
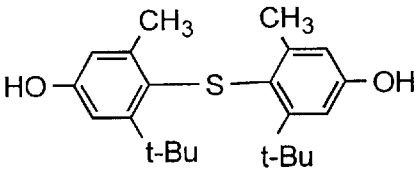
Figure 11:
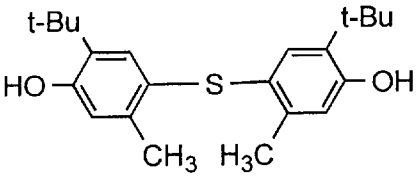
Figure 12:
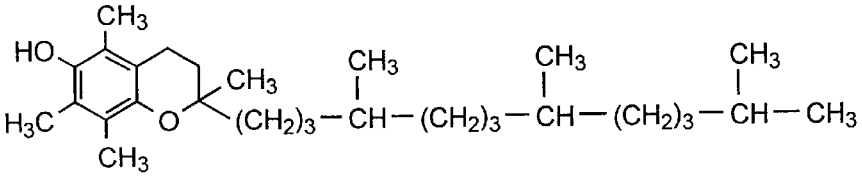
FIG. 12 describes the structural formulas IV-30 through IV-38 of the representative antioxidants.
Figure 12:
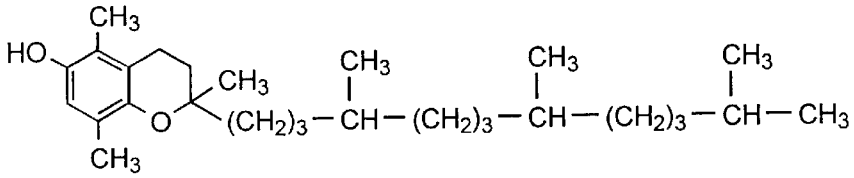
Figure 12:
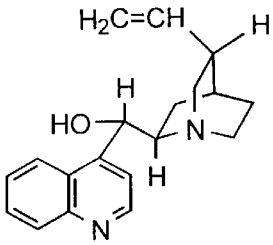
Figure 12:
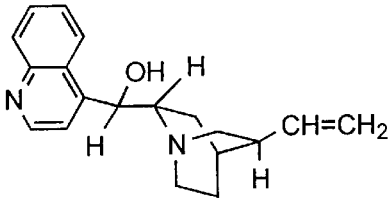
Figure 12:
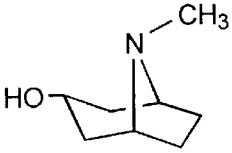
Figure 12:
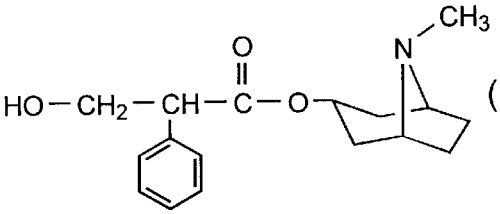
Figure 12:
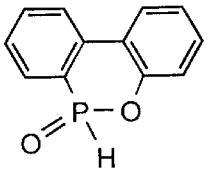
Figure 12:
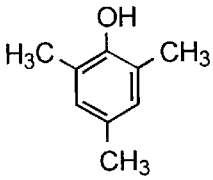
Figure 12:
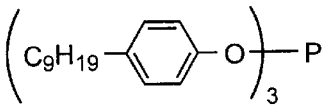
Figure 13:
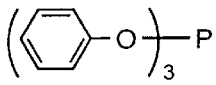
FIG. 13 describes the structural formulas IV-39 through IV-45 of the representative antioxidants.
Figure 13:
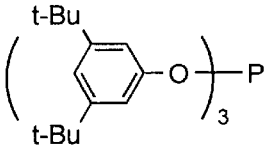
Figure 13:
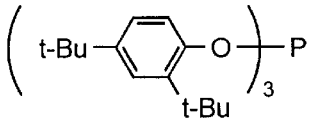
Figure 13:
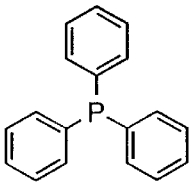
Figure 13:
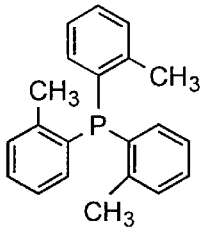
Figure 13:
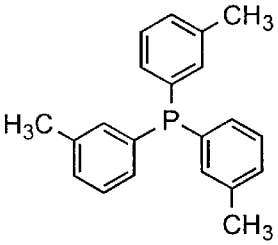
Figure 13:
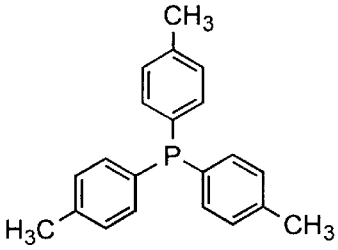

A coating liquid for the charge transport layer was prepared by dissolving 5 weight parts of a hydrazone compound, having the structural formula (II-1) as described in FIG. 5, 5 weight parts of another hydrazone compound, having the structural formula (II-2) as described in FIG. 5, 10 weight parts of bisphenol A-type-biphenyl copolymerized polycarbonate (TOUGHZET supplied from Idemitsu Kosan Co., Ltd.), having the structural formula (III4) as described in FIG. 7, and 1 weight part of a hindered phenolic compound, having the structural formula (IV-2) as described in FIG. 8, uniformly into 79 weight parts of methylene chloride. A 25 $\mu$m thick charge transport layer was formed by dip coating the charge transport layer coating liquid onto the charge generation layer and drying the coating liquid at 100° C. for 30 minutes.

The photoconductors of embodiments E1–E4 were fabricated according to the above instructions.

TABLE 1

Figure 14:
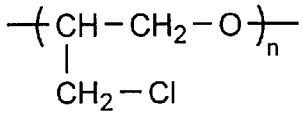
FIG. 14 describes the structural formula (V) of polyepichlorohydrin used in the undercoating film according to the invention.
Figure 15:
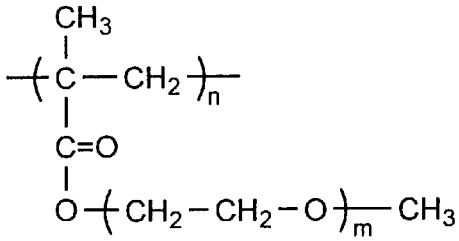
FIG. 15 describes the structural formula (VI) of poly (methacrylic acid), having a poly(ethylene oxide) structure introduced into the side chain thereof, used in the undercoating film according to the invention.
Figure 16:
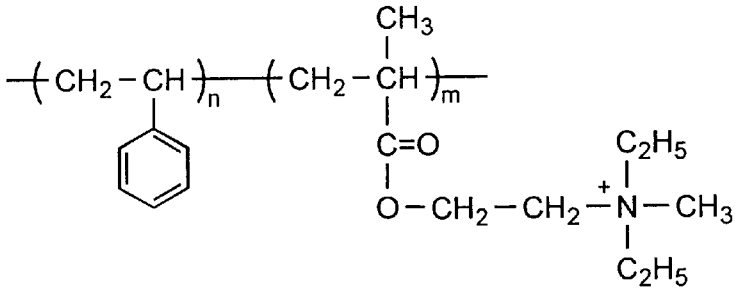
FIG. 16 describes the structural formula (VII) of polymethacrylate copolymer containing a quaternary ammonium base, used in the undercoating film according to the invention.
Figure 17:
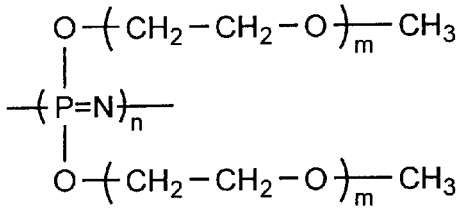
FIG. 17 describes the structural formula (VIII) of polyphosphazene, having a poly(ethylene oxide) structure introduced into the side chain thereof, used in the undercoating film according to the invention.

| Embodiment | Conductive Polymers | Alkaline Metal Salts |
|---|---|---|
| E1 | Polyepichlorohydrin Structural Formula (V) in FIG. 14 | Lithium perchlorate [$LiClO_4$] |
| E2 | Poly(methacrylic acid) with a poly(ethylene oxide) structure in a side chain Structural Formula (VI) in FIG. 15 | Tetrafluoromethane lithium sulfonate [$LiCF_3SO_3$] |
| E3 | Polymethacrylate copolymer containing a quaternary ammonium base Structural Formula (VII) in FIG. 16 | Lithium perchlorate [$LiClO_4$] |
| E4 | Polyphosphazene having a poly(ethylene oxide) structure in a side chain Structural Formula (VIII) in FIG. 17 | Lithium perchlorate [$LiClO_4$] |

Comparative Example 1 (C1)

The photoconductor (C1) according to comparative example 1 was fabricated in the same manner as the photoconductor (E1) of embodiment 1 except that lithium perchlorate was not added to the undercoating film of photoconductor (C1).

Comparative Example 2 (C2)

The photoconductor (C2) according to comparative example 2 was fabricated in the same manner as the photoconductor (E1) of embodiment 1 except that polyepichlorohydrin and lithium perchlorate were not added to the undercoating film of photoconductor (C2).

Comparative Example 3 (C3)

The photoconductor (C3) according to comparative example 3 was fabricated in the same manner as the photoconductor (E1) of embodiment 1 except that dimethylamine, a low-molecular-weight-type surface active agent, was used in photoconductor (C3) in place of polyepichlorohydrin and lithium perchlorate of photoconductor (E1).

The electrical properties of the photoconductors fabricated as described above were evaluated in an electrophotographic-process testing machine. The photoconductor surface was charged to be about −600 V by the corotron method while the photoconductor mounted on an electrophotographic-process testing machine was rotating at a circumferential speed of 60 mm/s. The surface potential when light was not irradiated was measured as the dark potential. The photoconductor surface was irradiated with 780 nm wavelength light at an illuminance of 2 $\mu W/cm^2$. After 0.2 seconds the potential was measured as the bright potential (residual potential). A running cycle consisting of charging and light exposure was repeated 100,000 times each in an ordinary environment (temperature: 23° C., relative humidity: 45%) and in a low temperature and low humidity environment (temperature: 5° C., relative humidity: 20%). Variations of the dark and bright potentials were measured. Then, the photoconductors were mounted on a laser beam printer and initial printing tests were conducted as described in the two previously described environments. The results are listed in Tables 2 and 3.

TABLE 2

| | Initial | | After 100000 cycles of running | | |
|---|---|---|---|---|---|
| | Dark potential (−V) | Bright potential (−V) | Dark potential (−V) | Bright potential (−V) | Initial printing quality |
| E 1 | 610 | 60 | 605 | 65 | Excellent |
| E 2 | 605 | 55 | 605 | 50 | Excellent |
| E 3 | 610 | 60 | 610 | 60 | Excellent |
| E 4 | 610 | 65 | 610 | 60 | Excellent |
| C 1 | 610 | 105 | 625 | 180 | Density: insufficient. |
| C 2 | 620 | 210 | 625 | 295 | Density: insufficient. After images (ghosts): caused |
| C 3 | 610 | 70 | 600 | 140 | Density: not uniform Fog: observed |

[Evaluation environment: Temperature: 23° C., Relative humidity: 45%]

TABLE 3

| | Initial | | After 100000 cycles of running | | |
|---|---|---|---|---|---|
| | Dark potential (−V) | Bright potential (−V) | Dark potential (−V) | Bright potential (−V) | Initial printing quality |
| E 1 | 610 | 75 | 610 | 75 | Excellent |
| E 2 | 610 | 60 | 605 | 65 | Excellent |
| E 3 | 615 | 70 | 610 | 65 | Excellent |
| E 4 | 610 | 70 | 610 | 70 | Excellent |
| C 1 | 620 | 160 | 630 | 300 | Printing: impossible |
| C 2 | 630 | 325 | 640 | 390 | Printing: impossible |
| C 3 | 620 | 140 | 625 | 210 | Density: insufficient Fog, After images: observed |

[Evaluation environment: Temperature: 5° C., Relative humidity: 20%]

As the results listed in Tables 2 and 3 clearly indicate, the dark potentials and the bright potentials of the photoconductors according to embodiments E1 through E4 change little with changes in the environment. The printing quality of the photoconductors according to embodiments E1 through E4 do not depend on the environment. Thus, the photoconductors according to the invention exhibit excellent electrophotographic properties.

As explained above, a photoconductor of the invention, includes an undercoating film that is not affected by environmental changes and exhibits stable electrical properties. The undercoating film according to the invention may be thickened without adversely affecting the electrophotographic properties of the photoconductor. A photoconductor including the undercoating film of the present invention causes little if any dielectric breakdown even when the photoconductor uses the contact charging method.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography comprising:

a conductive substrate;

an undercoating film on said conductive substrate;

a photosensitive film on said undercoating film;

said undercoating film comprising an electrically conductive polymer, an alkaline metal salt, a binder resin and an inorganic pigment.

2. The photoconductor according to claim 1, wherein said electrically conductive polymer is a polymer selected from the group consisting of a polymer having a poly(ethylene oxide) structure, a polymer having a polyester structure, a polymer having a polyimine structure, and a polymer having a quaternary ammonium base.

3. The photoconductor according to claim 1, wherein the glass transition temperature of said electrically conductive polymer is 120° C. or lower.

4. The photoconductor according to claim 1, wherein said alkaline metal salt is a salt selected from the group consisting of $CF_3SO_3$ salt, $ClO_4$ salt, $IO_4$ salt, $MoO_4$ salt, $WO_4$ salt, $BF_4$ salt, $SiF_6$ salt, $CS_3$ salt, SCN salt, $NO_3$ salt and $CO_3$ salt of an alkaline metal.

5. The photoconductor according to claim 4, wherein said alkaline metal salt is a salt selected from the group consisting of $LiCF_3SO_3$ salt, $LiClO_4$ salt, $LiIO_4$ salt, $Na_2MoO_4$ salt, $K_2WO_4$ salt, $LiBF_4$ salt, $NaBF_4$ salt, $K_2SiF_6$ salt, $K_2CS_3$ salt, LiSCN salt, $NaNO_3$ salt and $NaCO_3$ salt.

6. The photoconductor according to claim 1, wherein said binder resin is at least one of poly(vinyl butyral) resin, poly(vinyl alcohol) resin, poly(vinyl acetate) resin, polyacrylate resin, polymehtaxrylate resin, polyester resin, polyamide resin, polystyrene resin, polycarbonate resin, polyurethane resin, phenolic resin, epoxy resin or melamine resin.

7. The photoconductor according to claim 1, wherein said binder resin is a thermosetting resin.

8. The photoconductor according to claim 1, wherein the refractive index of said inorganic pigment is 1.8 or higher.

9. The photoconductor according to claim 1, wherein said inorganic pigment has an average grain diameter of less than about 0.4 $\mu$m.

10. The photoconductor according to claim 1, wherein said inorganic pigment has an average grain diameter of from about 0.2 to about 0.4 $\mu$m.

11. The photoconductor according to claim 1, wherein said inorganic pigment is treated with a silane coupling agent.

12. The photoconductor according to claim 11, wherein said silane coupling agent is selected from the group consisting of vinyltrichlorosilane, vinyltrimethoxysilane, vinyltriethoxysilane, vinyltriacetoxysilane, γ-glycidoxypropyltrimethoxy silane, γ-methacryloxypropyltrimethoxysilane, γ-aminopropyltrimethoxy silane, γ-aminopropyltriethoxysilane, γ-mercaptopropyltrimethoxysilane and γ-3,4-epoxycyclohexyltrimethoxysilane.

13. The photoconductor according to claim 1, wherein the total dose amount of the conductive polymer and the alkaline metal salt to the binder resin is from about 0.1 to about 30 weight %.

14. The photoconductor according to claim 1, wherein the total dose amount of the conductive polyment and the alkaline metal salt to the binder resin is from about 1 to about 10 weight %.

15. The photoconductor according to claim 1, wherein said photosensitive film comprises a charge generation layer and a charge transport layer.

16. The photoconductor according to claim 1, further comprising a resin film between said photosensitive film and said undercoating film.

* * * * *